United States Patent [19]

Coursen

[11] 4,239,286

[45] Dec. 16, 1980

[54] IN SITU LEACHING OF ORE BODIES

[75] Inventor: David L. Coursen, Mercersburg, Pa.

[73] Assignee: E. I. du Pont de Nemours and Company, Wilmington, Del.

[21] Appl. No.: 547,750

[22] Filed: Feb. 6, 1975

Related U.S. Application Data

[62] Division of Ser. No. 382,845, Jul. 26, 1973, abandoned.

[51] Int. Cl.[3] ..... E21B 43/28; E21C 41/14

[52] U.S. Cl. ..... 299/4; 299/13

[58] Field of Search ..... 299/4, 5, 13; 166/247, 166/271, 299

[56] References Cited

U.S. PATENT DOCUMENTS

| | | | |
|---|---|---|---|
| 3,630,278 | 12/1971 | Parker | 166/247 |
| 3,822,916 | 7/1974 | Jacoby | 299/4 |
| 3,823,981 | 7/1974 | Lewis | 299/4 |
| 3,841,705 | 10/1974 | Girard et al. | 299/4 |

*Primary Examiner*—Ernest R. Purser

[57] ABSTRACT

Producing a fracture network in deep rock, e.g., in an ore body, by detonating explosive charges sequentially in separate cavities therein, the detonations producing a cluster of overlapping fracture zones and each detonation occurring after liquid has entered the fraction zones produced by previous adjacent detonations. High permeability is maintained in an explosively fractured segment of rock by flushing the fractured rock with liquid, i.e., by sweeping liquid through the fracture zones with high-pressure gas, between sequential detonations therein so as to entrain and remove fines therefrom. Ore bodies prepared by the blast/flush process with the blasting carried out in substantially vertical, optionally chambered, drilled shot holes can be leached in situ via a number of holes previously used as injection holes in the flushing procedure and a number of holes which are preserved upper portions of the shot holes used in the detonation process. In the leaching of ore, fines are removed from fractures therein by intermittent or continuous flushing of the ore with lixiviant and high-pressure gas, e.g., air, using, in the case of the in situ leaching of an explosively fractured ore body, a lateral and upward flow of lixiviant from zones that have been less severely, to others that have been most severely, worked by multiple detonations in the ore body.

23 Claims, 4 Drawing Figures

SHOT HOLE PATTERN

IN SITU LEACHING OF ORE BODIES

This is a continuation, of application Ser. No. 382,845, filed July 26, 1973 now abandoned.

BACKGROUND OF THE INVENTION

The present invention relates to the production of a network of fractures in a deep underground segment of rock by means of explosives, e.g., to prepare deep ore bodies for in situ leaching.

Processes for fracturing deep rock are becoming increasingly important as it becomes necessary to tap deep mineralized rock masses, e.g., ore bodies or oil or gas reservoirs located from about 100 feet to about a few thousand feet beneath the earth's surface, in order to supplement or replace dwindling energy sources and minerals supplies. Numerous deposits of ore, for example ore containing copper, nickel, or silver, lie too deep to mine by open-pit methods or are too low in grade to mine by underground methods. Open-pit methods incur both the costs and the environmental impact associated with moving large quantities of earth and rock. Underground methods incur unusually high costs per unit volume of ore mined, as well as difficult safety problems. In contrast, the leaching of ore in place circumvents these difficulties and therefore can be a preferred technique for winning values from some ores that are unsuitable, or marginally suitable, for working by traditional mining methods.

Usually however, ore that is favorably situated for leaching in place has such a large fragment size and such low permeability to leaching solutions that the leaching rate would be too low to support a commercial leaching operation. In such cases, it becomes necessary to prepare the ore for leaching, by fragmenting it in a manner such as to provide the necessary permeability and leachability. The use of explosives to fracture underground segments of mineralized rock to create areas of high permeability has often been suggested. In an oil- or gas-bearing formation the fracturing is required to increase the overall drainage area exposed to the bore of a well penetrating the formation, and thus increase the rate at which hydrocarbon fluids drain toward the well. In an ore body the fracturing is required to increase the surface area of ore accessible to an injected lixiviant, and thus increase the leachability.

The use of nuclear explosives has been proposed for fracturing large-volume, deep ore bodies for subsequent in situ leaching. Also, the use of multiple chemical explosive charges in deep reservoir rock has been described in a method for stimulating hydrocarbon-bearing rock, e.g., in U.S. Pat. No. 3,674,089. However, if a deep ore body, i.e., one lying at depths of about from 100 to 3000 feet from the surface, is to be effectively leached in place, and the ore prepared for leaching by blasting, i.e., blasting in the absence of a free face for the ore to swell toward, it becomes necessary to employ special blasting and associated techniques which will provide and maintain the type of fracture network required for efficient leaching.

The leachability of a fractured ore body depends on the size of the ore fragments, and on the permeability of the intact ore as well as of the fracture system separating the fragments. The permeability of the fracture system separating the fragments, which is variable and generally much higher than the permeability of a single fragment, is determined by a network of wider, open fractures (determining the permeability of the ore body as a whole), and a network of narrower, open fractures (determining the irrigability of individual particles to be leached). Therefore, in explosively fracturing a segment of an ore body to prepare it properly for in situ leaching, the objective is not simply an indiscriminate reduction in the fragment size of the ore body. Smaller-size, well-irrigated fragments have a higher leaching rate than larger-size fragments, but fragment-size reduction by means of blasting processes heretofore known to the art, when applied to deep ore, tends to leave large unbroken fragments of rock, or to create a network of fractures that are largely closed or plugged with fines. An explosive fracturing process is needed which reduces the larger fragments to a size that will leach at an economically acceptable rate, and that will result in a network of open fractures throughout the blasted ore that will permit it to be well-irrigated with leach liquid.

SUMMARY OF THE INVENTION

This invention provides a process for producing a fracture network in a deep subsurface segment of rock, e.g., in an ore body, comprising (a) forming an assemblage of cavities, e.g., drill holes or tunnels, in the segment of rock; (b) positioning explosive charges in a plurality of the cavities in the sections thereof located in the segment of rock to be fractured, e.g., in sections of drill holes which have been previously chambered, such as by an explosive springing procedure; (c) providing for the presence of liquid in the segment of rock, e.g., by virtue of the location of the segment of rock below the water table so that water naturally is present in, or flows into, fractures therein, or by introducing liquid into one or more cavities therein; and (d) detonating the charges sequentially in a manner such as to progressively produce a cluster of overlapping fracture zones, the detonation of each charge in the detonation sequence producing a fracture zone which is subject to the cumulative effect of a succession of detonations of explosive charges in a group of adjacent cavities, and the detonation of the charge in each cavity being delayed until liquid is present in fracture zones produced by the previous detonation of charges in cavities adjacent thereto, as determinable by measuring the hydraulic potential, e.g., the liquid level, in the cavity, or in a cavity adjacent thereto.

When the cavities formed are substantially vertical drill holes, some of the holes in the assemblage preferably are left uncharged with explosive, and these holes employed as a set of passageways within the fracture network from the earth's surface, generally to substantially the bottom of the blasted rock, e.g., for the introduction of liquid and/or gas to (or removal thereof from) the fracture network. The uncharged holes preferably are drilled and provided with support casing prior to the detonation of charges in adjacent holes. The sections of substantially vertical shot holes located in the overburden that overlies the rock segment to be fractured preferably survive the blasting process and serve as an additional set of passageways, leading from substantially the top of the blasted rock to the earth's surface, also for liquid and/or gas passage.

In a preferred explosive fracturing process, liquid is driven through the fracture zones produced by the sequential detonation of explosive charges in a plurality of cavities in a segment of rock, in a manner such as to entrain the fines found in the fracture zones, and the fines-laden liquid removed from the rock. This flushing of the blasted rock is achieved by sweeping or driving liquid at high velocity through the fracture zones by injecting gas into said zones at high pressure, the liquid moving laterally and upwardly through the blasted rock, passing into the fractures, for example, from the passageways formed by uncharged substantially vertical drill holes and out of the fractures into passageways formed by preserved sections of substantially vertical detonated holes located in the overburden. Best results are achieved when substantially each detonation is followed by a flushing step applied to the fracture zone thereby produced, before the next detonation in an adjacent cavity occurs, and this is preferred. In the leaching of a mass of ore, e.g., in the in situ leaching of an explosively fractured ore body or in dump leaching, fines also preferably are flushed out of fractures therein by sweeping the lixiviant therethrough at high velocity by high-pressure gas.

The term "deep" as used herein to describe a subsurface segment of rock denotes a depth at which the detonation causes no significant change in the overlying topography, i.e., the surface does not swell. As a rule, "deep" rock as described herein lies at a depth of at least 100, and usually not more than 3000, feet. "Fracture zones" and "fractured rock" herein denote zones and rock in which new fractures have been formed, or existing fractures opened up, by the detonations. "Fracturing" denotes herein a treatment which reduces the size of, and/or misaligns, rock fragments.

BRIEF DESCRIPTION OF THE DRAWING

The explosive fracturing process of the invention will be described with reference to the attached drawing in which.

DETAILED DESCRIPTION OF THE INVENTION

Figure 2:
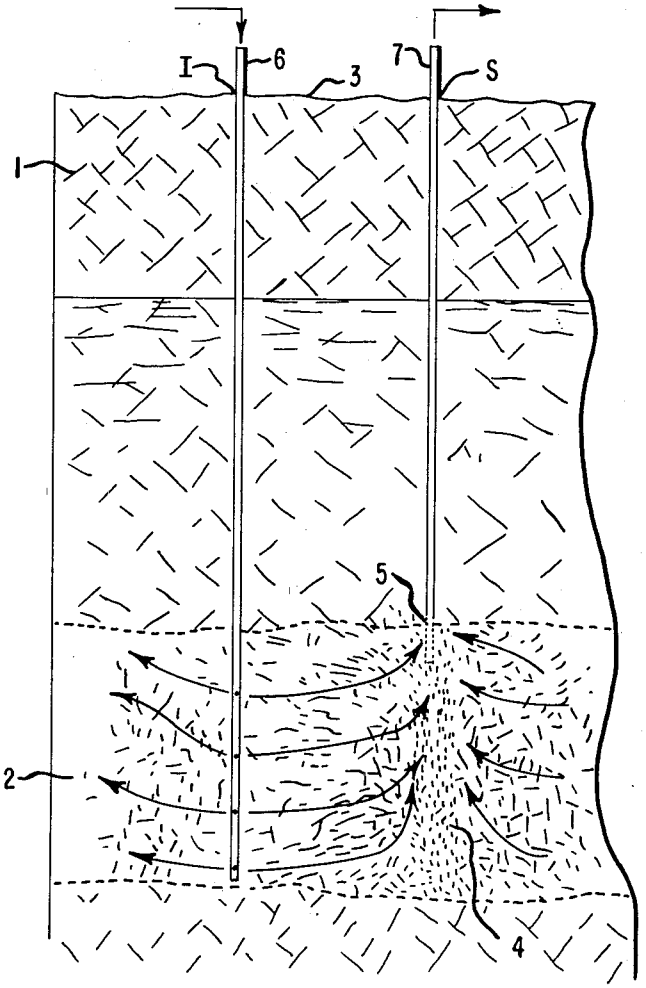
FIG. 2 is a schematic representation in elevation showing the surface-to-surface liquid circulation pattern through the segment of rock shown in FIG. 1.

In the present process, explosive charges are detonated sequentially in separate cavities in a segment of mineralized rock to be fractured, each detonation in the sequence producing a zone of fracture in the rock and being delayed until liquid is present in the fractured rock around the cavity containing the charge to be detonated, especially in fracture zones produced by the previous detonation of charges in cavities adjacent thereto. Thus, the detonations occur while fractures in the surrounding rock are filled with liquid, or the rock is in a flooded, or liquid-soaked, condition. The cavities, e.g., drill holes or tunnels, containing the explosive charges are spaced sufficiently close together, and the charges are sufficiently large, that the fracture zones produced by the detonations therein overlap one another. Thus, each fracture zone is within the region of influence of other detonations and is subject to the cumulative effect of a succession of detonations of explosive charges in a group of adjacent cavities. This cumulative effect permits the fragment size-reduction and disorientation needed to enhance leachability to be obtained readily from the available explosive energy. The degree of overlapping of the fracture zones, which are generally cylindrical in shape, is at least that required to locate all of the rock, in the segment of rock to be fractured, within the fracture zone produced by the detonation of at least one of the charges.

The cavities in the assemblage in which explosive charges are to be detonated (i.e., blast cavities) can be substantially vertical holes (shot or blast holes) drilled into the segment of rock from the surface or from a cavity in the rock, or substantially horizontal cavities such as tunnels, driven in the rock, e.g., from a hillside or shaft. Whether the cavity volume is provided by tunnel driving techniques such as are employed in coyote blasts, for example, or drilling techniques, possibly associated with chambering procedures, will be largely a question of economics, although technical practicability depending on such factors as topography, compressive strength of the rock, etc., will influence the selection of the method. Substantially vertical drill holes are preferred in many cases since the preserved sections of the shot holes can be used subsequently as passageways to or from the fractured rock, reducing the number of holes needed to be drilled solely to provide passageways for liquid injection or ejection.

Although the blast cavities need not form a regular pattern, and regularity of pattern actually may not be desirable or practical, a somewhat regular pattern is indicated in a formation of reasonably uniform contour, structure, and physical strength to assure a high degree of uniformity in the fracture network produced. In some cases, as core tests reveal unpredictable changes in the rock occurring during the sequential blasting process, it may be desirable to deviate from a regular pattern, e.g., to use one or more additional blast cavities where needed to provide the required overlapping of fracture zones. Nevertheless, substantial regularity of pattern generally will be provided in the arrangement of most of the blast cavities. It will be understood, of course, that in the case of substantially vertical drill holes the actual pattern of the holes within the segment of rock to be fractured may approach, rather than match, the hole pattern at the surface, inasmuch as the available drilling equipment may not be counted on to produce parallel holes at depths of the order considered herein.

Regardless of the blast cavity pattern employed, the distance between explosive charges (and, also therefore, between cavities) of a given composition and size is such that a cluster of overlapping fracture zones is produced by the detonation of adjacent charges. Although it may not be possible to delineate the fracture zones with precision, the extent or radius of the fracture zone that can be expected to result from the detonation of an explosive charge of a given composition, density, shape, and size under a given amount of confinement in a given geological mass can be approximated by making some experimental shots and studying the fracture zones surrounding the blast cavities by using one or more geophysical methods. Such methods include (1) coring, (2) measurements in satellite holes of compressional and shear wave propagation, of permeability, and of electrical conductivity, and (3) acoustic holography. Based on these studies, the cavities are spaced close enough together to provide the required overlapping of fracture zones.

"Adjacent" blast cavities or explosive charges, as described herein, are blast cavities or explosive charges which, although spaced from one another, are immediate or nearest neighbors to one another, as contrasted to blast cavities or explosive charges which are more distant neighbors or separated from one another by one or more other blast cavities or explosive charges.

Although I do not intend that my invention be limited by theoretical considerations, the delaying of each detonation until liquid is present in the fracture volume surrounding the cavities is believed to have two beneficial effects. First, the liquid can lubricate the fractures so that opposing faces can move suddenly in shear more easily, thereby enhancing fragmentation of the surrounding rock, which is no longer supported by the relatively high resistance of a dry fracture to transient shear. Secondly, liquid-filled fracture volume cannot be rammed shut by the suddenly applied pressure of an explosion. This incompressible behavior, together with the low resistance of the liquid-filled fractures to sudden small displacements in shear, is believed to cause disorientation of individual rock fragments and dilation and swelling of the bed of fragments as a whole. Each detonation creates a misalignment or disarrangement of fragments with an accompanying increase in void volume. Therefore, when the fracture zones produced by the successive detonations in adjacent cavities partially overlap, the fracture zone around each cavity thereby being subject to additional fracturing and/or disorientation produced by the detonations in the adjacent cavities, and previously produced fracture zones are flooded, each fracture zone will be swelled in increments, with each detonation jacking it to larger volume, and higher permeability, against the pressure of the surrounding rock. The present process makes use of the lubricating effect and incompressible behavior of the liquid in the fractures, and does not require the use of high liquid pressures, e.g., of the magnitude needed to lift the overburden and enlarge the fractures before blasting. A liquid pressure in the fractures at the time of blasting equal to the head of liquid above the blast zone is sufficient. Also, any readily available, relatively cheap liquid, e.g., water or water mixtures, can be used to flood the rock. If leaching of ore is performed in the course of the detonation sequence, a lixiviant can be used as the flooding liquid. For reasons of economy as well as because of the safety risks associated with the use of explosives which are sensitive enough to detonate in extremely small diameters, the use of explosive liquids in the fracture zones is not contemplated. Any fluid explosive which may be used in the present process will be gelled to a viscosity that will hinder any appreciable loss thereof from the blast cavities to the surrounding fracture zones, and in any case will not be sufficiently sensitive to be detonated in said zones. Thus, while small amounts of the explosive charges may escape into the fracture zones, such material will behave as a non-explosive liquid therein. Accordingly, the flooding liquid is non-explosive.

Figure 1:
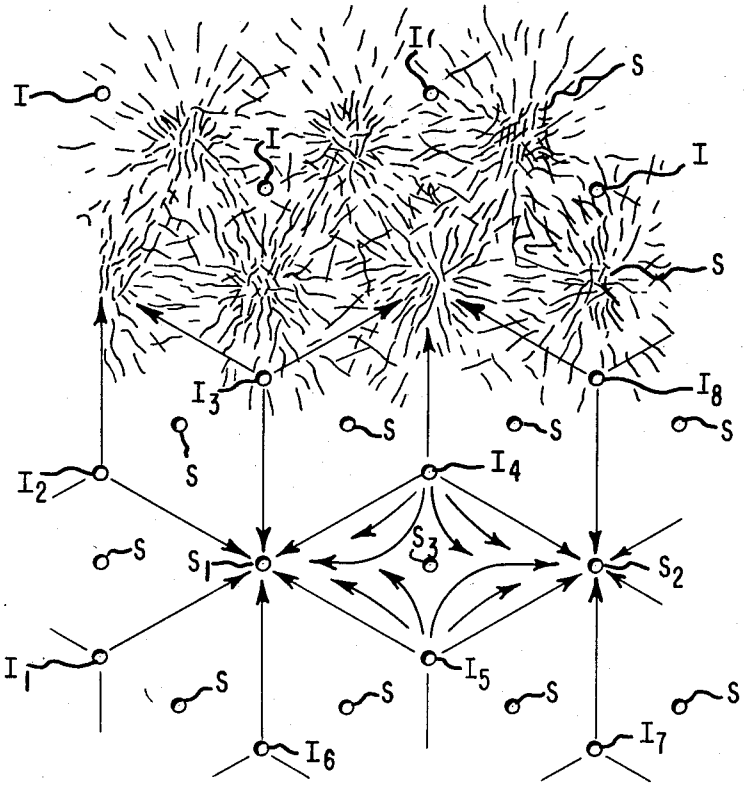
FIG. 1 is a schematic representation in plan view of a subsurface segment of rock which has been fragmented by the blast/flush process of the invention, and the liquid circulation pattern between holes therein.

A preferred blast cavity pattern for use in the present process is one in which substantially all of the internal cavities, i.e., cavities not located at the edge of the pattern, are surrounded by at least four adjacent blast cavities, e.g., a pattern in which the blast cavities are at the corners of adjacent polygons, which are either quadrangles or triangles and which are as close to equilateral as permitted by wander of the cavities, as shown in FIG. 1.

Although all of the blast holes in a group of adjacent substantially vertical drill holes can be drilled prior to the sequential detonation of the charges, this procedure is not preferred inasmuch as it could be necessary to apply a support casing to the as-yet undetonated holes in the sections thereof located in the segment of rock to be fractured to prevent them from collapsing as a result of detonations in adjacent holes. Casing of the shot holes in these sections usually would be considered economically unsound because the casing would occupy volume that could otherwise be loaded with explosive and because casing in these sections of the holes is not needed in subsequent leaching operations. Therefore, it is preferred that in a group of adjacent drilled shot holes the detonation of each charge takes place before adjacent shot holes are drilled. In practice, one might drill and, if desired, chamber (as described later), one shot hole of a group of adjacent holes, load the hole or chamber with explosive, allow water to enter the formation surrounding the hole or chamber, and detonate the charge, and then repeat the sequence of steps with adjacent holes. In each successive sequence of steps, the entrance of water into the formation can occur prior to, or during, any of the other steps, however. The avoidance of the presence of drilled shot holes during detonations refers to holes in a group of adjacent holes, e.g., a central hole and four to six surrounding holes. However, shot holes farther removed from the detonations can be pre-drilled.

The total amount of drilling needed for vertical-cavity blasting can be reduced by drilling one or more branch or off-set holes by side-tracking from one or more points in the preserved upper portion of a trunk hole which extends to the surface. Each off-set hole is drilled after the charges in the trunk hole and other off-set holes thereof have been detonated. Such holes will be inclined at small angles to one another.

Most of the ore bodies and other mineralized formations to which the present process is expected to be primarily applicable will be located below the water table, and in such a case, unless the section to be blasted rises locally above the water table, or the rock surrounding this section is so impermeable that flooding of the fracture zone does not occur by natural flow, the section will be naturally flooded, or water-soaked, before the sequential blasting begins, and after a certain period of time has elapsed after each detonation to allow the water to flow naturally into the newly formed fractures. If natural flooding is incomplete or absent, water or some other liquid can be pumped into the cavity to be shot after the explosive charge has been emplaced therein, and also into any available nearby uncharged cavities, at a sufficiently high flow rate to cause the rock to be blasted to be in a flooded condition at the time of detonation.

As stated previously, liquid is present in the rock around each cavity prior to the detonation of the charge therein. This means that liquid is present in any pre-existent fractures in the zone which will become a fracture zone as a result of the detonation of the charge in that cavity, and in fractures produced by previous detonations in cavities adjacent thereto. This condition permits the above-described incremental swelling of overlapping fracture zones to take place. In the case of substantially vertical drill holes, the liquid level in the rock around the hole should be at least as high as the top of the charge in the hole, thereby assuring the presence of liquid throughout the height of the formation where fracturing will occur. With horizontal cavities, the liquid level in the rock around the cavity should be at least as high as the radius of fracture to be produced by the detonation of the charge therein. When the segment of rock to be fractured is located below the water table, the position of the water table above it will conform to the water levels in undisturbed holes, and may be inferred at other locations by interpolation between the elevations of the water levels in undisturbed holes. As a practical matter, the water table will almost always be sufficiently horizontal that the first charge can be detonated when the elevation of the liquid level in any nearby hole is at least as high as the elevation to be reached by the top of the charge (or radius of fracture in the horizontal cavity case). If the liquid level is measured in the cavity in which the charge is to be detonated, the level before loading of the explosive into the cavity should be the level measured. After the detonation, the liquid level in cavities within the resulting fracture zone drops in proportion to the new fracture volume produced, the expulsion of liquid from the immediate vicinity of the charge by the gaseous products of detonation, and the drainage of liquid into the cavity created by the detonation. The detonation of the next charge in the sequence in a cavity adjacent to the first is delayed until the liquid in the formation around the next cavity (including the new fracture volume produced by the previous detonation in an adjacent cavity) returns to its required level. It is understood, however, that explosive charges in blast cavities elsewhere in a section of the formation that is not strongly influenced by a previous detonation (i.e., where the liquid level has not dropped below the required elevation as a result of the previous detonation) can be detonated at any time after the previous detonation. The delay to allow flooding applies to detonations in cavities which are adjacent to previously detonated cavities, where the previously formed fracture zones will be subject to the effect of the next detonation.

As was stated previously, some of the holes in an assemblage of substantially vertical holes preferably are left uncharged with explosive, these holes providing passageways to the fractured rock to allow the introduction of gases and/or liquids thereto, e.g., in a subsequent leaching operation. These holes, which can thus be looked upon as injection holes (although they may serve as ejection or recovery holes depending on the required flow pattern), are also useful in preparing the ore body for leaching, as will be described more fully hereinafter, and it is preferred, on the basis of ease of drilling, that they be drilled prior to the sequential detonation process in holes surrounding them. Pre-drilled injection holes are provided with a support casing, e.g., unperforated pipe grouted to the upper part of the hole wall, at least in the section thereof located in the segment of rock to be fractured, and ungrouted perforated pipe or a wellscreen in the bottom section of the hole, in order to prevent hole collapse as a result of the detonations. Inasmuch as full-length casing will be required for subsequent leaching operations, however, the full length of the injection holes usually will be cased prior to blasting. Damage to the injection piping is minimized in the present blasting process owing to the sequential, long-delay character of the multiple detonations.

The location and pattern of the injection holes are selected on the basis of their intended function during the fracturing and leaching processes, which will be described in detail hereinafter. The overall purpose of these holes usually is to provide a means for introducing gases and/or liquids into the fracture network produced, or being produced, and therefore the injection holes should be distributed throughout the segment of rock among the blast cavities in a manner such that they lie within the fracture zones produced by the detonations. After the detonation of the charge in a substantially vertical shot hole, the resulting fracture zone permits communication between a neighboring injection hole and the portion of the shot hole remaining in the overburden. The shot hole remnants thereby act as passageways to complete the liquid circuit through the fractured rock.

If injection holes are present in the formation during the sequential detonation process, an injection hole lying within the fracture zone produced by a previous detonation in a cavity adjacent to a cavity to be shot can be employed to determine whether the liquid level in the rock surrounding the cavity to be shot has recovered sufficiently to flood the section to be blasted. Whenever an hydraulic potential (e.g., a liquid level) measurement is required after a blast cavity has been loaded with explosive, a nearby injection hole can be used. When the segment of rock to be blasted is at least partly above the water table, liquid is introduced into the rock in the cavity to be shot, in previously detonated cavities adjacent thereto, and/or in nearby injection holes. Flooding via multiple cavities is preferred. Liquid is run into a blast cavity after the explosive charge has been emplaced therein (if the charge is stable in the presence of water), and liquid level measurements, if required, are made in nearby injection holes. It should be understood that, in practice, hydraulic potential measurements, e.g., pressure measurements made with a piezometer, or liquid level measurements, will not be required after each detonation, inasmuch as the experience gained in determining the necessary delay times to permit recovery of hydraulic potential between a few of the early detonations in the sequence will usually allow the practitioner to select with confidence suitable delay times to be used between subsequent detonations.

Although the exact delay required depends on the size of each blast, the void volume to be filled, the elevation of the segment to be blasted relative to the water table, and the hydraulic transmissibility of the surrounding rock, delays on the order of hours or days generally will be needed. As a practical matter, the time required for a shot hole to be drilled, or a tunnel to be driven, and loaded with explosive usually will be more than sufficient for the hydraulic potential around the cavity and the previously detonated adjacent cavities to recover to the minimum required level either by natural influx of water from the surrounding rock or by introduction through cavities made in the formation. In general, delay times between detonations of at least about one hour, and typically in the range of about from 4 to 24 hours, are sufficient for flooding to take place, although much longer delays, e.g., in the range of about from 4 to 30 days, may be employed in order to prepare the next blast cavity for blasting. It will be understood that these delays refer to the time between detonations of adjacent charges, and that one or more charges whose zones of fracture are non-adjacent (i.e., whose regions of influence are mutually exclusive) can be detonated at much shorter delay times or even simultaneously.

I have found that when sequential blasting is carried out in less competent, broken, or clayey rock, the permeability of the rock may be decreased, although the fracture volume is increased, by the blasting. Lost permeability can be restored by flushing of the fractured rock, i.e., by sweeping or driving liquid through the fractures at high velocity and removing the fines-laden liquid from the rock, preferably after each detonation. The flushing procedure appears to remove from the fractures the clogging fines that prevent free irrigation around the rock fragments. Such fines are present in the form of existing clays and rock crushed or abraded during blasting.

The flush can be accomplished by the pressure injection of liquid and gas into the fractured rock through one or more injection holes, and removal of the fines-laden liquid from the fractured rock by bringing it to the surface through one or more detonated shot holes, in the preserved sections of the latter which pass through the overburden to the surface. Liquid and gas, e.g., water or other aqueous liquid and air or oxygen, can both be injected; or gas alone can be injected so as to sweep ahead the liquid already present in the fractures. Alternatively, a liquefied gas, such as air, nitrogen, oxygen, can be introduced into the injection holes and allowed to vaporize therein and thereafter drive the liquid through the fractures. Inasmuch as there is a two-phase flow in a generally upward direction and laterally in the direction of the detonated shot holes, the circulation of the liquid is powered by gas lift such that the gas chases the liquid upward and outward through the broken formation, and fines are driven toward the zones of severest fracture, where their concentration is heaviest, from which zones they are ejected with the liquid. This direction of sweep is preferred inasmuch as the reverse direction drives the fines more deeply into the less severely worked zones of the formation away from their point of heaviest concentration and can cause an intensified clogging of the fractures. The surging high-velocity flow which develops with the upward two-phase flushing system removes fines that prevent free irrigation around the fragments. If necessary to achieve the required lateral circulation of liquid between injection hole and ejection hole throughout the length of the fracture zones being flushed, two or more vertically separated injection zones in a given injection hole can be employed, one substantially at the bottom of the fractured rock and one or more others above it.

The buoyancy of the pressurized gas alone can be sufficient to raise the fines-laden liquid to the surface of the ground when the water table is relatively close to the surface. When the water table is so deep that the buoyancy is insufficient, the liquid can be pumped up the collar of the shot hole.

At the start of flushing, the gas injection pressure should be higher than the ambient hydrostatic pressure at the position in the injection hole where injection occurs, and preferably higher than the lithostatic pressure at this position. The minimum gas pressure required for flushing is highest at the start of the operation and falls as gas injection proceeds.

Although there can be much variation in the number of fracture zones being flushed out at any given time, and the nature and number of other operations which can be performed during flushing, it is preferred that a detonation in any given cavity be followed by detonations in no more than two or three adjacent cavities, and most preferably by a detonation in no adjacent cavity, before the fracture zone produced by the detonation in the given cavity has been flushed out as described. In some formations, if a given fracture zone is subjected to a number of subsequent detonations without the intervention of flushing, restoration of permeability by a later flushing becomes difficult because the fractures may have become plugged up too tightly with fines. Therefore, a cyclic blast/flush/blast/flush, etc. process is preferred. One or more fracture zones can be flushed at the same time, and flushing of the same zone can be repeated, if desired. An already flushed zone can be left untreated during the flushing of adjacent zones by plugging the ejection hole in that zone. Flushing of one or more zones can be carried out while adjacent blast cavities are being drilled and loaded.

In the present process, the detonation of the charges in sequence permits the preservation of the sections of substantially vertical shot holes that pass through the overburden (the strata overlying the rock segment being worked), and these sections of the shot holes can serve as ejection holes in the flushing process, as described above. The reduced fragment size and unclogged fracture network achieved after all of the charges have been detonated, and the detonations followed by a flushing procedure, produce, in the case of an ore body, an ore which is well-prepared for in situ leaching.

The present invention also provides a leaching process wherein fines are flushed out of a mass of ore by driving lixiviant through the mass by means of high-pressure gas, e.g., in a specific circulation pattern. According to one embodiment of the present leaching process, an ore body which has been prepared for leaching by detonating explosive charges in separate cavities therein, e.g., according to a process of this invention, is leached in situ by introducing lixiviant for the ore into the prepared ore body through a plurality of injection holes therein and intermittently or continuously driving the lixiviant through the ore body to a plurality of recovery holes by means of high-pressure oxidizing gas, the lixiviant moving laterally and upwardly from zones that have been less severely worked, to others that have been most severely worked, by the detonations, whereby fines are removed from the ore body. When the ore body has been prepared for leaching by means of the abovedescribed blast/flush process the lixiviant for the ore can be injected into the ore body through injection holes which have previously been used in the flushing steps, and fines-laden pregnant leach solution recovered from the ore body through the preserved upper portions of shot holes, piping having been grouted into all holes used to circulate lixiviants and pumps provided as necessary to inject lixiviants in one set of holes and remove pregnant liquor from another set of holes. The bottom ends of the pipes and any other positions along the pipes where lixiviants are to be injected or collected are provided with perforations or wellscreens.

The lixiviant (e.g., sulfuric acid/water or sulfuric acid/nitric acid/water for ores whose acid consumption is within tolerable levels, or $NH_4OH$/water for ores having a high acid consumption), which is a liquid, and a gas, usually an oxidizing gas, preferably oxygen, air, $NO_x$, or mixtures thereof, are injected into the base of the prepared ore body at high pressure. As in the case of flushing between blasts, this type of injection gives a circulation powered by gas lift such that the gas chases the liquid through the broken rock. Even with constant flow rates of gas and liquid at the injection holes, a surging, high-velocity flow develops in the rock which is believed to be beneficial in (1) removing fines around the ore fragments (such fines being created during the leaching process in forms such as decrepitated ore slimes and precipitated iron salts), (2) increasing the leaching rate as a result of the cyclic squeezing of the ore fragments from the pressure fluctuations associated with the surging flow, and (3) working the ore gently so as to collapse wide openings among the fragments that may develop during the leaching process and can cause channelling of leaching solution. Sweeping the lixiviant laterally toward collection points in the more severely worked fracture regions of the ore body, and from injection points in the less severely worked regions reduces the chances that a more intense clogging of the ore body with fines will occur.

The circulation pattern employed in the leaching process as well as in the flushing steps of the fracturing process may be understood more clearly by reference to the accompanying drawing. In FIG. 1, the holes designated by the letter S are substantially vertical shot holes. Within the blasted segment of rock, these holes are destroyed by the detonations which have taken place therein in the fracturing process and are replaced by the adjacent, overlapping fracture zones shown in the upper half of the figure, and also denoted by the letter S, to indicate a previous shot hole. The shot holes rather than the fracture zones are shown in the lower half of the figure so that liquid circulation lines can be indicated clearly. It should be understood, however, that upon completion of the entire blast sequence all shot holes are surrounded by fracture zones (as depicted in the upper half of the figure) in the sections thereof located in the rock segment that was blasted. In the sections overlying the blasted segment, the shot holes remain substantially intact and in these sections all shot holes appear as they are shown in the lower half of the figure. The preserved upper sections of the shot holes are ejection holes in the flushing steps of the blasting process, and recovery holes in the leaching process. In the hole arrangement illustrated in FIG. 1, the shot holes are arranged in a trigonal pattern wherein lines between adjacent holes form substantially equilateral triangles.

The holes designated I are injection holes. These holes are uniformly distributed among the shot holes as shown. The arrows indicate the direction of flow of liquid from injection holes $I_1$, $I_2$, $I_3$, $I_4$, $I_5$ and $I_6$ to the preserved upper section of shot hole $S_1$; and from injection holes $I_4$, $I_5$, $I_7$, $I_8$, and two other undepicted injection holes to the preserved upper section of shot hole $S_2$. The preserved upper section of shot hole $S_3$ is plugged off while shot holes $S_1$ and $S_2$ are being used for flushing or as recovery holes for pregnant leach solution. At the same time, liquid injected into these injection holes is being driven to other open shot holes.

In FIG. 2, piping in injection hole I and shot hole S is shown as it passes through overburden 1 to the fractured rock segment 2. Piping 6 in injection hole I leads from the earth's surface 3 to substantially the bottom of rock segment 2. Piping 7 in shot hole S leads from the earth's surface 3 to the top of rock segment 2. Fracture zone 4 has been produced by the detonation of an explosive charge in shot hole S, which before the detonation led to substantially the bottom of rock segment 2. Piping 7 terminates in well screen 5, and piping 6 is provided with perforations vertically spaced along the length thereof located in rock segment 2. In the flushing steps of the fracturing process, and in the leaching process, liquid is injected into fractured rock segment 2 through the perforations in piping 6, then is driven by pressurized gas through the fractured rock as indicated by the arrows, and leaves the top of the rock segment through piping 7. Lateral as well as upward flow occurs from the less severely worked zone around hole I to the most severely worked zone, i.e., fracture zone 4.

Regulation of the rate at which gas and liquid lixiviant are injected and collected at the various injection and collection holes allows a high degree of control of the in situ leaching process. By the operation of control valves, the injection and collection pressures can be regulated to obtain a relatively uniform flow through the ore body in spite of variations in permeability from place to place. Shifting the injection or collection from one set of holes to another will change the direction of flow through the ore and can be used to frustrate channelling. The regulation of pressures and flow rates at the various holes can be used to maintain a net flow of ground water toward the operation under conditions that might otherwise result in the escape of leach solution. Leakage of the leach solution is also reduced in the present process as a result of the carriage of some of the fines away from the area of gas agitation where they settle out and plug the leak. In leaching, the gas/liquid pressure injection can be intermittent or continuous, depending upon the degree to which the ore tends to plug up, and the frequency with which flow patterns are changed to obtain uniform and complete leaching throughout the ore.

When lixiviant is introduced into an injection hole simultaneously with gas, its injection pressure should be equal to that of the gas, i.e., higher than the ambient hydrostatic pressure at the injection point, and preferably higher than the lithostatic pressure at this point. In some cases, especially at greater depths, the injection of lixiviant and oxidizing gas at sufficient pressure to exceed the lithostatic pressure may be necessary in order to get sufficient flow rate through the ore. If, in some or all of the injection holes, there are periods of time when lixiviant alone is introduced into the ore, this introduction preferably is done at a pressure at least as high as the lithostatic pressure at the injection position. That is, the pumping pressure preferably is at least as high as the lithostatic pressure minus the heads of fluid in the piping leading from the pump to the injection position.

According to the present invention, permeability can be increased also in ore masses such as mine waste dumps by driving lixiviant through fractures therein by means of gas at sufficiently high pressure that the lixiviant is swept through at a rate sufficiently high to entrain fines present in the fractures, and removing the fines-laden lixiviant from the ore mass.

In a preferred embodiment of the present process, the sections of substantially vertical shot holes which are located in the segment of rock to be fractured are first chambered to larger diameter, and the explosive charges positioned in the chambered portions. In this procedure, drilling costs are reduced by drilling widely spaced-apart shot holes of smaller diameter than is required to accommodate the size of explosive charges to be employed, and enlarging or "springing" the lower parts of the shot holes to produce chambers having the volume required to hold the explosive charge. The sections of the holes in the rock segment are chambered either by drilling them out, e.g., with an expansion bit, or by detonating explosive charges therein. The chambering method is not critical, the preferred method generally being the one that results in the lowest overall cost per unit of chamber volume for the particular rock segment in question. In the present process, explosive charges used for springing may be 20 feet or more in length. If rock fragments tend to fall from the walls of an explosively sprung hole and thus to occupy some of the volume required for the explosive charge subsequently to be used in producing the fracture zone, the hole to be sprung can be drilled deeper so that the bottom of the hole is located below the bottom of the formation. In this manner, any loss in volume that is to be available for explosive loading is minimized since a portion of the chamber volume below the segment of rock to be fractured can hold the fallen rock fragments.

The advantage of chambering the shot holes before loading them with the charges which will be detonated to produce the fracture network becomes evident when it is considered that an explosively sprung hole typically will hold about ten times as much explosive as an unsprung hole. Thus, for example, a pattern of 30-inch-diameter charges on 100-foot spacings (center-to-center) typically can be achieved by drilling 9-inch-diameter holes on 100-foot spacings.

Although the blast/flush process has utility in deep underground blasting with explosives of all types, the use of chemical explosive charges is much preferred for several reasons. The many technical as well as civil (legal, political, public relations) problems associated with the undertaking of nuclear blasting are self-evident. Vibration effects and radioactivity are the two major roots of these problems. A nuclear blast which is large enough to be economically feasible must be set off at sufficient depth, e.g., preferably appreciably deeper than 1000 feet, in order to be safely contained and not release radioactivity to the atmosphere. Many potentially workable ore bodies will not be located as deep as the safe containment depth. Furthermore, the extreme magnitude and concentration of the energy produced in a nuclear blast imply that it will be difficult, if not impossible, to achieve (a) a high degree of uniformity in explosion-energy distribution and ore breakage, (b) close hydraulic control of the flow of lixiviants without an appreciable amount of additional drilling to increase the number of injection and extraction points, and (c) a close match of the broken volume with the outline of the ore body, particularly for small or irregular ore bodies, such a match resulting in economies in the use of the available explosive energy and in the consumption of lixiviants.

While single explosive charges generally will be detonated in sequence to produce the fracture zones, the charges also can be multi-component charges positioned in separate cavities and detonated substantially simultaneously as a group to produce each fracture zone, each detonation in the sequence of detonations in such a case being a group of detonations.

The following example illustrates specific embodiments of the process of the invention.

The formation to be fractured was a bedded series of shales and silt stones, dipping about 45°, located at a depth of 70 to 90 feet below the surface, and therefore subjected to a lithostatic pressure of about 70 to 90 p.s.i. The water table was at a depth of about 15 feet below the surface. A 3-inch-diameter hole was drilled into the formation to a depth of 100 feet. This hole was used as a coresampling and permeability-testing hole, and also as an injection hole for purposes of flushing surrounding shot holes. A core test revealed a competent silty shale at the 70–90 foot depth. A well screen was installed in the hole at the 70–90 foot level, and piping to the well screen was grouted to the hole. Cement filled the hole below the well screen.

Figure 3:
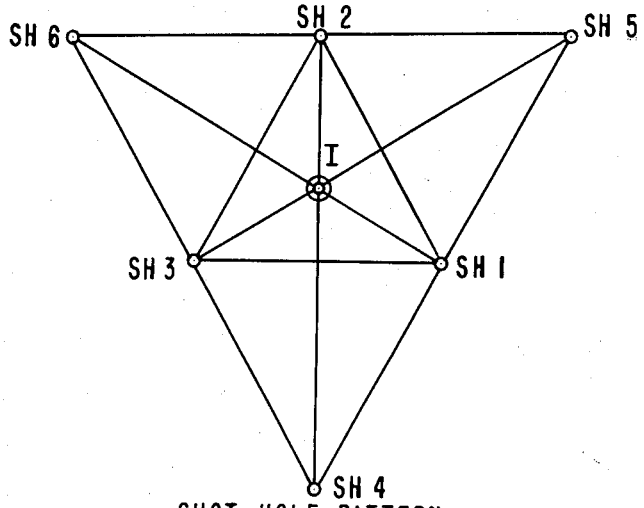
FIG. 3 is a schematic representation of a shot hole pattern described in the example.

The pattern of shot holes used is shown in FIG. 3. Three shot holes (SH 1, SH 2, and SH 3) were located 16.25 feet from the injection hole I, their centers lying on 120° radii from the center of hole I and the lines joining them forming an equilateral triangle. The distance between these shot holes was 28 feet. Three shot holes (SH 4, SH 5, and SH 6) were located 32.5 feet from hole I, their centers also lying on 120° radii from the center of hole I, and the lines joining them (also forming an equilateral triangle) being bisected by the centers of holes SH 1, SH 2, and SH 3. The distance between holes SH 4, SH 5, and SH 6 was 56 feet. It is seen that in this arrangement the lines joining adjacent (i.e., nearest neighbor) shot holes formed equilateral triangles. SH 1, SH 2, and SH 3 each had four shot holes adjacent thereto (SH 2, SH 3, SH 4, and SH 5 for SH 1; SH 1, SH 3, SH 5, and SH 6 for SH 2; and SH 1, SH 2, SH 4, and SH 6 for SH 3), and SH 4, SH 5, and SH 6 each had two shot holes adjacent thereto (SH 1 and SH 3 for SH 4; SH 1 and SH 2 for SH 5; and SH 2 and SH 3 for SH 6).

Shot hole SH 1 was drilled first. The hole was 5 inches in diameter and 91 feet deep and was located with 255 pounds of an aluminized water gel explosive having the following composition: 18.9% ammonium nitrate, 10.5% sodium nitrate, 29.6% methylamine nitrate, 30% aluminum, and 11% water. The explosive column was 21.7 feet high, and was covered by a layer of water which naturally flowed into and filled the remainder of the hole and stemmed the explosive charge. The water level in the injection hole was above the level of the top of the explosive charge in the shot hole, indicating that the rock surrounding the shot hole was properly flooded. Before the explosive charge was initiated, the permeability and sound velocity of the rock surrounding the injection hole were measured. The permeability was determined by slug tests, in which the permeability is inferred from the rate at which the head of liquid subsides toward the ambient level in a hole after the rapid introduction of a slug of liquid therein (see Ferris, J. G., et al., "Theory of Aquifer Tests", U.S. Geological Survey, Water-Supply Paper 1536-E, 1962). The sound velocity, measured at depths of 74.5 feet to 85 feet between the injection hole, shot hole SH 1, and a test hole collared 13 feet on the opposite side of the injection hole, was 3970 meters per second.

The explosive charge in shot hole SH 1 in the flooded formation was detonated, whereupon the water level in the injection hole dropped to below its pre-detonation level, as a result of the formation of a new fracture volume around shot hole SH 1, the chasing of water from the rock fractures by the gaseous detonation products, and the flow of water into the cavity created by the explosive charge. After partial recovery of the water level in the injection hole, the second shot hole (shot hole SH 2) was drilled to the same size as shot hole SH 1, and the rock surrounding shot hole SH 1 was then flushed with water by (a) blowing compressed air into the bottom of the open injection hole, (b) injecting water through a packer in the injection hole, and (c) three long air injections, and then (d) 18 short air injections through a packer in the injection hole. The total flushing time was about 4 hours. Silt-laden water was ejected from shot hole SH 1 (but not shot hole SH 2) during the flushing, indicating the preservation of the top of shot hole SH 1, the circulation of the water from the bottom of the rock segment (bottom of the injection hole) laterally and upward through the fracture network to the top of the rock segment (bottom of shot hole SH 1), and the removal of fines from the fractures. The permeability was measured in the injection hole (as described above) before and after the flushing operations.

Shot hole SH 2 and subsequently drilled shot hole SH 3 were loaded and the charges therein detonated as described for shot hole SH 1.

The water level in the injection hole returned to its pre-detonation level, above the level of the top of the explosive charge in shot hole SH 1 before detonation, in about 18 hours. Thereafter, the charge in shot hole SH 2 was detonated, whereupon the water level in the injection hole again dropped to below its pre-detonation level. The rock surrounding shot hole SH 2 was flushed with water, and silt-laden water ejected from shot hole SH 2, by sealing off shot hole SH 1 and (a) injecting air through a packer in the injection hole, (b) blowing compressed air into the bottom of the open injection hole, and (c) injecting air through a packer in the injection hole, followed by water through the packer while blowing compressed air into the bottom of shot hole SH 3. The total flushing time was about 11 hours. The permeability was again measured before and after the flushing operations.

After the water level in the injection hole had returned to its pre-detonation level, the charge in shot hole SH 3 was detonated, and the surrounding rock flushed by (a) air injection through a packer in the injection hole, followed by sealing off shot hole SH 1 and blowing air down shot hole SH 2 and shot hole SH 3 to drive water to each shot hole in turn until water was exhausted from the broken rock; and (b) two air injection flushings, each followed by water injection. The total flushing time was about 7 hours. The permeability was again measured before and after the flushing operations.

The remaining shot holes, SH 4, SH 5, and SH 6, were drilled, loaded, and detonated in the same manner as holes SH 1, SH 2, and SH 3, with the detonations occurring after the return of the water level in the injection hole to its predetonation level. Between the shooting of shot holes SH 4 and SH 5, the rock surrounding hole SH 4 was flushed by three air injections in the injection hole, each followed by water injection; between the shooting of shot holes SH 5 and SH 6, the rock surrounding hole SH 5 was flushed by injecting air into the injection hole, and blowing air down hole SH 6 (unshot), separately and simultaneously; and after hole SH 6 was shot, the rock surrounding it was flushed by alternately injecting air into the injection hole and blowing air down the surviving section of hole SH 6.

Figure 4:
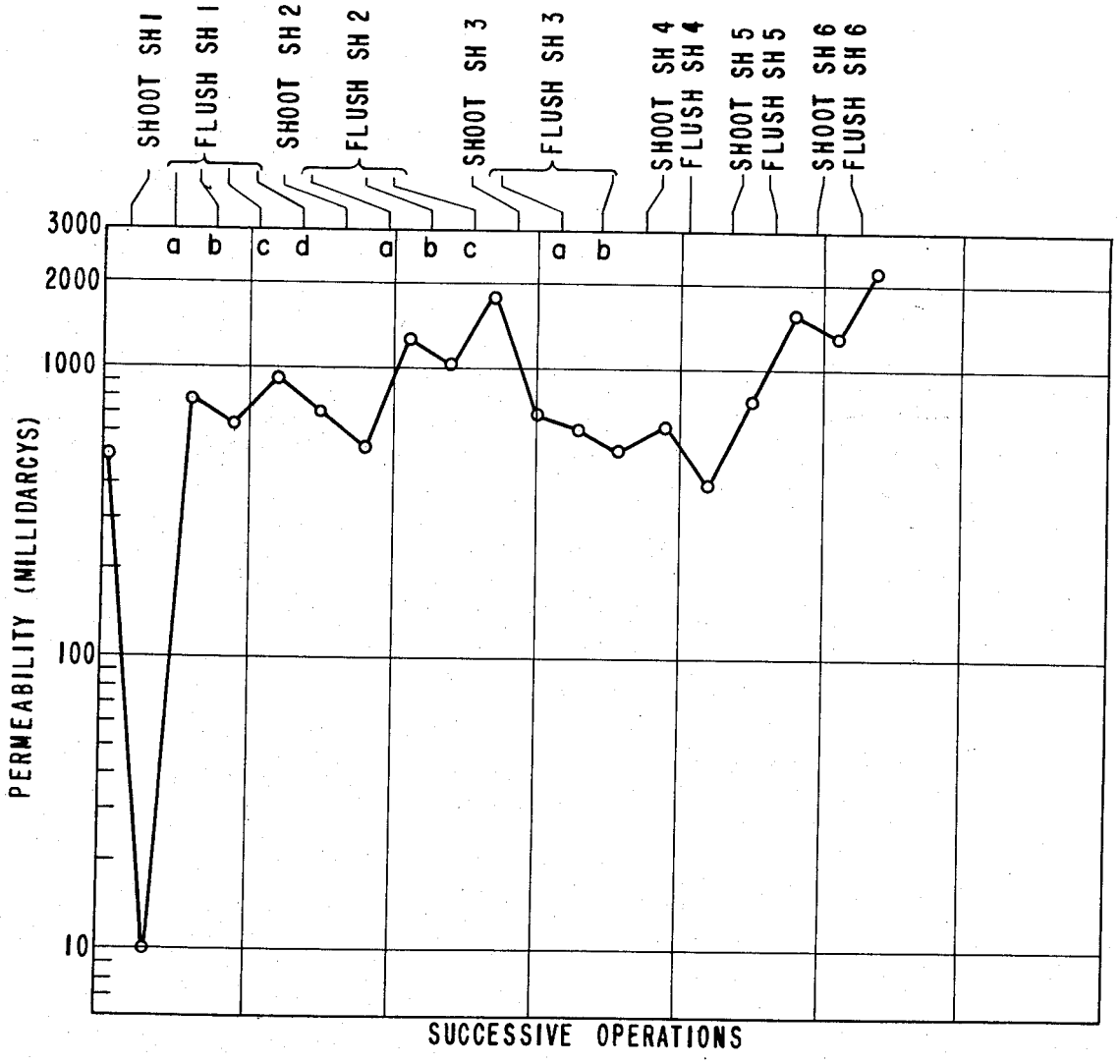
FIG. 4 is a plot showing the effect of repeated blast/-flush operations on the permeability of a fracture zone produced with the shot hole pattern shown in FIG. 3.

The permeabilities measured by slug tests in the injection hole before the blast/flush process began and after each blast and flush operation at each of the six holes are plotted in FIG. 4 as a function of the operation performed, the permeabilities being presented in millidarcys on a logarithmic scale as the ordinate. Nineteen points are shown, including those obtained after the four flushing procedures (a, b, c, and d) described above after the shooting of hole SH 1; three flushing procedures (a, b, and c) after the shooting of hole SH 2; and two flushing procedures (a and b) after the shooting of hole SH 3. Each point denotes the average permeability measured after a given operation.

The plot shows that the permeability of the rock was increased considerably (from 500 to over 2000 millidarcys) by the total six-cycle blast/flush process, and that variations in permeability occurring during the cyclical shooting and flushing tend to decrease as the rock is broken and swelled. The plotted experimental values also show that the rapid flow of water to the remnant of a shot hole achieved by means of air injection through another hole or by strong pumping from a shot hole (by blowing air into the bottom of an open shot hole, for example) increases the permeability after blasting, best results having been achieved when both air injection at the injection hole and strong pumping at a nearby shot hole was used. While blasting was found generally to decrease the permeability, permeability which had previously been reduced by the injection of water (alone or as a final flushing step after blasting) was increased by blasting.

The degree of dilation produced in the rock by the first three of the above-described detonations in flooded rock was estimated from calculations of porosity based on sound velocity measurements. The sound velocity around the injection hole after the three blasts was 3650 meters per second at a 12 foot radius from the hole, and 2530 meters per second through paths in the blasted rock running from the shot holes in to the injection hole (compared with 3970 meters per second in the same prism of rock before blasting). The total porosity in the rock ($\psi$) was calculated from the following empirical equation for the sound velocity ($\alpha$, in m/sec) as a function of porosity, for flooded ocean sediments having various degrees of lithification:

$$\psi = -50.748 \ln\alpha + 432.23.$$

Total porosity before blasting: 11.7%

Total porosity after blasting: (12-ft. radius) 16.0%

Total porosity after blasting: (center to shot holes) 34.6%

These porosities imply that the fracture volumes caused by the blasting were 4.3% (12-ft. radius) and 22.9% (center to shot holes).

I claim:

1. A process for the in situ leaching of an ore body which has been worked by detonating explosive charges in separate cavities therein to produce in the ore body immediately adjacent to the site of each detonation a fracture zone comprised of a most severely fractured core portion surrounded by a less severely fractured outer portion, comprising introducing lixiviant for the ore into the ore body through a plurality of injection holes in the less severely fractured portions and recovering pregnant leach solution from the ore body through a plurality of recovery holes in the most severely fractured portions.

2. A process of claim 1 wherein the ore body has been worked by the detonation of chemical explosive charges.

3. A process of claim 2 wherein the injection holes extend from the earth's surface to substantially the bottom of the ore body, and the recovery holes extend from the earth's surface to substantially the top of the ore body.

4. A process of claim 3 wherein the recovery holes are preserved upper portions of shot holes in which explosive charges have been detonated.

5. A process of claim 1 wherein the lixiviant is injected at a pressure at least as high as the lithostatic pressure at the injection position.

6. A process of claim 5 wherein gas is introduced into the injection holes with the lixiviant.

7. A process of claim 6 wherein the gas is injected at a pressure in excess of the lithostatic pressure at the injection position.

8. An improved process for recovering metal values by in situ leaching an ore body located below the water table which comprises:

(a) forming in an ore body a fracture zone comprised of a most severely fractured core portion surrounded by a less severely fractured outer portion whereby the fracture zone contains fractured metal-bearing ore particles;

(b) injecting a leach solution through one or more injection wells located in the ore body adjacent to but outside the most severely fractured portion, the leach solution solubilizing metal values in the ore body and in the most severely fractured portion; and (c) recovering a metal-containing leach solution through one or more production wells located in the most severely fractured portion.

9. The process of claim 8 wherein the fracture zone is produced by detonating one or more strategically placed explosives in the ore body, said explosive selected from nuclear and chemical explosives.

10. The process of claim 8 wherein the ore body contains a copper-bearing ore.

11. The process of claim 10 wherein the leach solution is injected through the one or more injection wells at a pressure less than the formation fracture pressure.

12. The process of claim 11 wherein the leach solution contains a dispersion of an oxygen-bearing gas.

13. The method of leaching a metal-bearing ore in place which comprises:

(a) injecting a leach solution at a pressure below the formation fracturing pressure through at least one injection well located in a less severely fractured outer portion which surrounds a most severely fractured core portion of a fracture zone of a metal-bearing ore body located below the water table;

(b) allowing the leach solution to remain in the ore body to solubilize metallic ions present in the ore body; and (c) recovering metallic-ion-containing leach solution from at least one production well located in a most severely fractured portion of a fracture zone in the ore body.

14. The process of claim 13 wherein the ore body contains copper-bearing ore.

15. The process of claim 14 wherein the leach solution is aqueous sulfuric acid containing an oxygen-bearing gas.

16. An improved process for recovering metal values by in-situ leaching an ore body located below the water table which comprises:

a. forming a rubblized zone in an ore body whereby the rubblized zone contains fractured metal bearing ore particles;

b. injecting a leach solution through one or more injection wells located in the ore body adjacent to but outside the rubblized zone, the leach solution solubilizing metal values in the ore body and in the rubblized zone; and c. recovering a metal containing leach solution through one or more production wells located in the rubblized zone.

17. The process of claim 16 wherein the rubblized zone is produced by detonating one or more strategically placed explosives in the ore body, said explosive selected from nuclear and chemical explosives.

18. The process of claim 16 wherein the ore body contains a copper bearing ore.

19. The process of claim 18 wherein the leach solution is injected through the one or more injection wells at a pressure less than the formation fracture pressure.

20. The process of claim 19 wherein the leach solution contains a dispersion of an oxygen bearing gas.

21. The method of leaching a metal bearing ore in place which comprises:

a. injecting a leach solution at a pressure below the formation fracturing pressure through at least one injection well located in a non-rubblized zone of a metal bearing ore body located below the water table;

b. allowing the leach solution to remain in the ore body to solubilize metallic ions present in the ore body, and c. recovering metallic ion containing leach solution from at least one production well located in a rubblized zone in the ore body.

22. The process of claim 21 wherein the ore body contains copper bearing ore.

23. The process of claim 22 wherein the leach solution is aqueous sulfuric acid containing an oxygen bearing gas.

* * * * *

UNITED STATES PATENT OFFICE

CERTIFICATE OF CORRECTION

PATENT NO. : 4,239,286

DATED : December 16, 1980

INVENTOR(S) : David L. Coursen

It is certified that error appears in the above-identified patent and that said Letters Patent are hereby corrected as shown below:

Title page, item designated as [62] under "Related U.S. Application Data: delete ", abandoned". Col. 1, line 5: delete "abandoned" and substitute -- U.S. Patent 3,902,422 --.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*